United States Patent [19]

Newton, Jr.

[11] 4,089,519

[45] May 16, 1978

[54] STARTING BLOCK ASSEMBLY

[76] Inventor: Milton A. Newton, Jr., 877 Kincaid St., Inglewood, Calif. 90302

[21] Appl. No.: 772,770

[22] Filed: Feb. 28, 1977

Related U.S. Application Data

[63] Continuation-in-part of Ser. No. 657,705, Mar. 5, 1976, abandoned.

[51] Int. Cl.[2] ..... A63B 69/00

[52] U.S. Cl. ..... 272/105

[58] Field of Search ..... 272/105

[56] References Cited

U.S. PATENT DOCUMENTS

| | | | |
|---|---|---|---|
| 2,900,187 | 8/1959 | Hondorp | 272/105 |
| 2,937,871 | 5/1960 | McCafferty | 272/105 |
| 3,494,615 | 2/1970 | Moore | 272/105 |
| 3,608,897 | 9/1971 | Ross | 272/105 |

FOREIGN PATENT DOCUMENTS

| | | | |
|---|---|---|---|
| 287,585 | 12/1966 | Australia | 272/105 |

*Primary Examiner*—Jerome Schnall
*Attorney, Agent, or Firm*—Howard L. Johnson

[57] ABSTRACT

A starting block assembly for locating at a starting position of a running track. An elongated, ground-anchorable central bar is formed with a pair of back-to-back T-shape lengthwise slide tracks, each opening to a respective side of the bar and receiving therethrough an L-shaped runner which extends from the side of a respective starting block having a spring-tensioned anchor pin receivable in a series of positioning sockets located along the bar. Each triangular shaped block has concave front and rear, transverse contact faces, one with a resilient surface and the other spike-receiving openings to accommodate the shoes of a user. Use of a chosen surface depends on the directional positioning of the assembly. The T-track is self-cleaning of grit which might otherwise jam movement of the L-runner along the track, due to possibility of transversely rocking the block on the longitudinal axis of the runner when the anchor pin is disengaged.

1 Claim, 4 Drawing Figures

STARTING BLOCK ASSEMBLY

CROSS REFERENCE TO RELATED APPLICATION

This is a continuation-in-part of Ser. No. 657,705, filed Mar. 5, 1976, now abandoned.

BACKGROUND OF THE INVENTION

Starting blocks have long been used by runners to position each foot at a chosen position at the starting line of a running track. That is, an individual runner has worked out over an extended period of training and experience, just exactly what position each of his feet should be at in order to make the best possible take off. Such a staring position may indeed determine the winner in a close race and accordingly the runner wants to have the blocks always resettable at the precise positions which he has found best, and always to have each block always firmly anchored without the possibility of wobble or slip in response to the pressure of his foot against it. Indeed to insure this, experienced runners may even carry their own (custom fashioned) starting block assembly with them from one track to another. Also, since such assemblies are continuously or practically always used in an immediate environment of either outdoor dirt or indoor dust and grit, it is important that the movable element or block setting-mechanism be both capable of secure anchorage at any chosen position along the bar and also that any slideway or track be kept reasonably free of interfering particles which may cause it to bind or jam. The realization of such objects is obtained in a notably effective manner by the present invention.

BRIEF STATEMENT OF THE INVENTION

The invention provides a starting block assembly formed of an elongated, generally rectangular and flat-sided frame or bar, terminally anchorable selectively in dirt or synthetic surfacing of a running track by corresponding spike means. Each longitudinal vertical side of the frame is formed with a side-open T-slot or slideway, each of which carries an L-shaped glide runner extending therein laterally and upwardly from a generally triangularly shaped, open-bottom, foot-contact starting block. Each of the pair of blocks has a spring-loaded anchorage or locator pin engageable with one of a longitudinal series of indicia-marked sockets located adjacent each block and individually spaced apart along the length of the frame. Each block has one concave, contact face formed with cleat-receiving openings, and an opposite, concave, contact face carrying a resilient or rubber-like facing pad, the curvature of either contact face corresponding to the instep curvature of the runner's foot. The runner has the choice of either pair of contact surfaces merely by aligning the assembly or frame with the chosen surface facing forward; that is, by reversing the assembly 180° he can make available the other pair of faces. The spring-tensioned anchorage pin of each block ensures a positive retension at any selected socket, while precision-pinning of a brass runner to the (cast) block eliminates possibility of wobble of the block itself. In addition, comparative looseness of the upward-projecting arm of the L-runner in the upper portion of the T-track makes it possible, when the anchorage pin is disengaged, to rock the block and runner as a unit, transversely to the frame so as to clear contacting grit from the upper portion of the T-track and allow it to drop into the lower unoccupied portion of the track. Any such amount which accumulates in the lower portion can be blown out or dropped therefrom simply by upending the assembly.

DETAILED DESCRIPTION OF PREFERRED EMBODIMENT

Figures 1, 2, 3, 4:
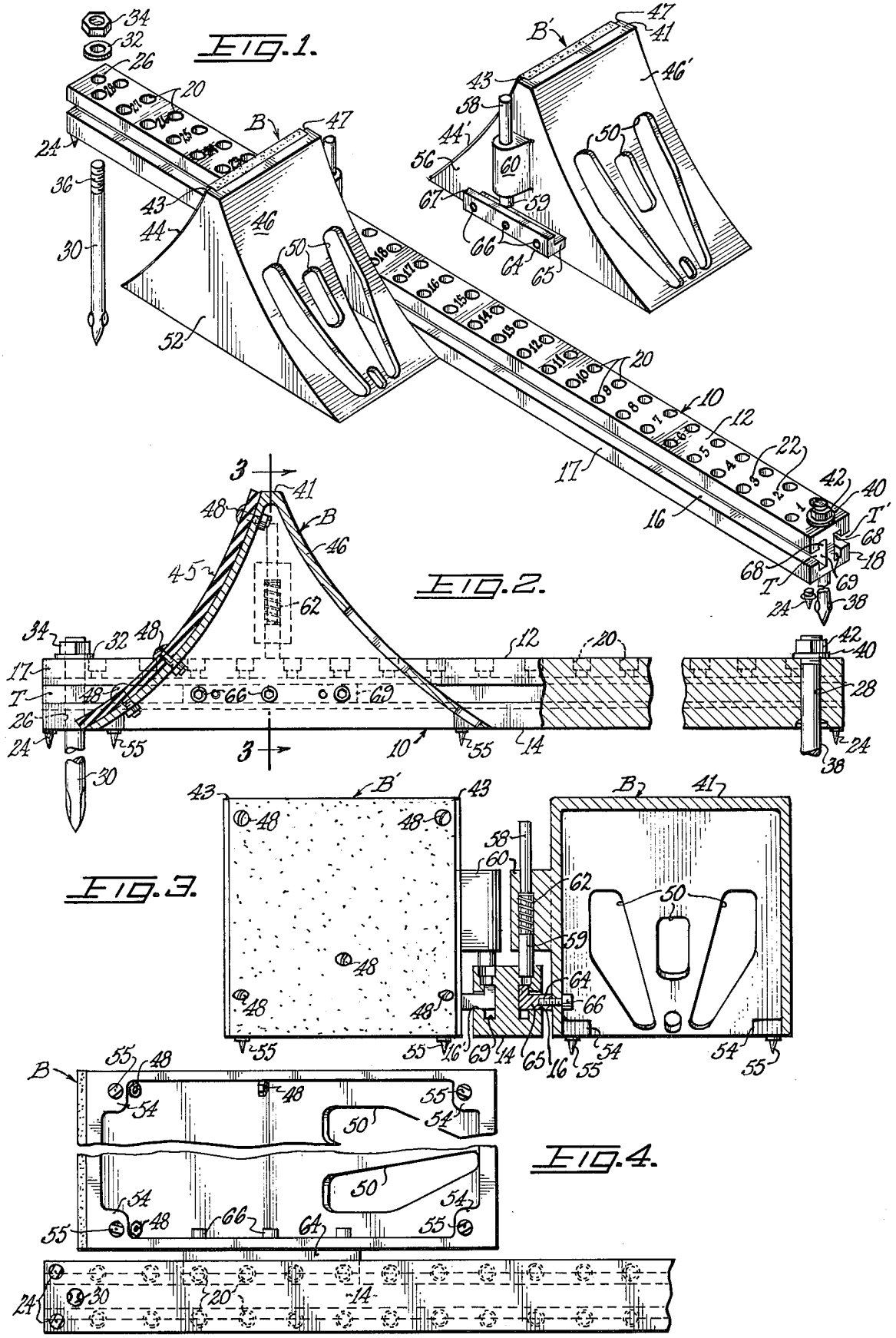
FIG. 1 is a perspective view of my Starting Block Assembly with the right starting block shown detached with parts broken away and the components of the left end ground-anchorage spike of the frame shown separate in exploded view.
FIG. 2 is a side elevational view of the frame and one starting block, partly in vertical section.
FIG. 3 is a transverse vertical view taken on line 3—3 of FIG. 2 extending through the frame and right starting block, with the left block seen in elevation.
FIG. 4 is a bottom plan view of the frame and one attached starting block.

The invention provides an elongated, generally rectangular bar or frame 10 with flat top 12 and bottom 14 faces, conveniently formed of extruded aluminum with a similar pair of back-to-back T-shaped tracks or slideways T, T', making the bar bilaterally symmetrical. The long arm of the T, horizontally directed, forms an open slot 16, 16' extending lengthwise along each side wall 17, 18 of the bar. The cross arms of the T form respectively upper portions and lower portions of the track as hereafter explained. Adjacent each edge of the upper face 12 is a lengthwise series of vertical sockets 20, individually spaced apart a uniform distance, which may be designated by a central calibration or indicia scale 22.

The underface 14 may carry a plurality of short projections or spikes 24 and in addition, adjacent each end, the bar is formed with a vertical aperture 26, 28 adapted for insertion of longer anchorage members. There may be a fairly long, ribbed spike 30 particularly used for anchorage in outdoor ground or the like. After the addition of a washer 32 and apertured head 34, the top 36 may be peened for permanent coupling to the bar. Alternately, when the assembly is used on an indoor track such as one with synthetic coating (variously known as "Tartan" or other trade name), a shorter, terminally threaded, anchorage stake 38 with upper washer 40 and terminal nut 42 may be used. Usually the same type spike is used at each end (depending on whether the anchorage is in ground or synthetic coating) but a different unit is here shown for each end for ease of explanation.

The two starting blocks B, B' are identical except that the coupling elements are on opposite sides, like mirror images. Each is generally triangular in end elevation with upstanding walls curving toward a crest line 41. Each such wall 44, 46 is concave or dished to conform roughly to the instep curature of the runner's shoe forward of the heel; that is, the runner's heel may be placed above the crest or rim 41 of the block. One curved face 44, 44' retains a resilient or rubber-like facing pad 45 located between edge shoulders 43, 47 and held by bolts or fasteners 48. The opposite curved face 46, 46' is formed with a pattern of openings 50 which loosely receive the bottom spikes or cleats (not shown) of a runner's field shoes when the shoe is held thereagainst. The outer side wall 52 of a block is generally planar, and the bottom of the triangle is open except for corner support tabs 54 which support short projecting spikes 55.

The inner, side wall 56 of a block, that is, adjacent the bar 10 and slideway T, carries a laterally projecting, upright tubular housing 60 which forms part of the cast block, which is vertically traversed by an anchorage pin 58, the lower end 59 of which is adapted to engage or seat in any selected one of the sockets 20 with which it is brought in alignment, being held therein by a compression spring 62.

Spaced below the pin housing 58, an L-shaped runner 64, desirably made of brass, extends outward horizontally from the side wall 52, being secured firmly to the wall by transverse pins 66. In assembly, the horizontal arm 65 of the L projects into the open slot 16 of the adjacent T-track so as to dispose the upright arm 67 of the L somewhat loosely in the upper portion of the track. Thus when the end 59 of the anchorage pin is held up out of the sockets 20, the block B or B′ in such position can be slid back or forth in a straight line (and without tilting) to locate it at a new position. However, when the spring tensioned pin is lodged in a selected socket 20, the block B, B′ is securely held alongside the bar without slack or possibility of wobble due to the relative tight engagement of the pin 58 and the stability resulting from the length of the L-runner 64 in the T-track. But upon disengagement of the anchorage pin 58, the comparative looseness of the vertical arm 67 of the runner in the upper portion 68 of the track allows the block and runner (as a unit) to be (manually) rocked transversely, so as to disengage any runner-contacted dirt or grit from the upper portion 68 of the track and cause it to drop into the lower portion 69. From here it can be readily expelled from time to time at either end of the track. Sometimes the respective ends of this lower portion 69 may be plugged with a wad of paper or the like (not shown) to block entry of dirt therein.

I claim:

1. A starting block assembly comprising, in combination:

an elongated frame adapted for location at the start of a running track and having an upper surface with a longitudinal series of socket means individually spaced apart therealong, plus a mutually parallel pair of upright walls disposed one adjacent each longitudinal side thereof, each such side wall characterized by a side opening of a generally T-shape track extending lengthwise along the frame, the cross arm of each said T-shape track being vertical and forming upper and lower portions, a pair of generally triangularly shaped, foot-contact blocks, each having an opposing pair of upstanding concave faces disposed transverse to said frame, one concave face being formed with a pattern of spike-receiving openings and the other concave face bearing a resilient contact surface, each block carrying a tensioned anchorage pin for tensioned engagement with individual socket means of said series to anchor the block at a selected position, each block carrying an elongated laterally-extending, generally L-shaped runner inserted through an adjacent one of said side openings said L-shaped runner consisting of a horizontal arm and a vertical arm extending upwardly from said horizontal arm movably occupying only said upper portion of said T-shaped track, being lengthwise slidable linearly therealong together with its block upon disengagement of said anchorage pin from the socket means, and upon such disengagement said block and runner as a unit being selectively, transversely rockable along the longitudinal axis of the track so as to dislodge contacting particles of dirt and the like from the upper portion of said track and allow them to drop into the lower portion thereof.

* * * * *